US005082584A

United States Patent [19]

Loth et al.

[11] Patent Number: 5,082,584

[45] Date of Patent: * Jan. 21, 1992

[54] MICROEMULSION ALL PURPOSE LIQUID CLEANING COMPOSITION

[75] Inventors: Myriam Loth, Saint Nicolas; Claude Blanvalet, Angleur; Baudouin Valange, Gembloux, all of Belgium

[73] Assignee: Colgate-Palmolive Company, Piscataway, N.J.

[ * ] Notice: The portion of the term of this patent subsequent to Dec. 24, 2008 has been disclaimed.

[21] Appl. No.: 85,902

[22] Filed: Aug. 14, 1987

Related U.S. Application Data

[63] Continuation-in-part of Ser. No. 866,029, May 21, 1986.

[51] Int. Cl.[5] ..... C11D 9/00; C11D 17/00

[52] U.S. Cl. ..... 252/122; 252/174.11; 252/174.16; 252/174.21; 252/170; 252/171; 252/162; 252/174.19

[58] Field of Search ..... 252/174.11, 174.19, 252/123, 128, 131, 108, 122, 174.16, 174.21, 170, 171, 162

[56] References Cited

U.S. PATENT DOCUMENTS 4,511,488 4/1985 Matta ..... 252/162
4,540,448 9/1985 Gautier et al. ..... 252/DIG. 14

FOREIGN PATENT DOCUMENTS 0040882 12/1981 European Pat. Off. .
0137616 4/1985 European Pat. Off. .
0316726 5/1989 European Pat. Off. .
2144763 3/1985 United Kingdom .
2190681 11/1987 United Kingdom .

OTHER PUBLICATIONS

Chemical Abstracts, vol. 105 (1986), No. 8 at p. 128 (designates 105:62775b) reporting on Japanese Patent 61012798.

*Primary Examiner*—Josephine Barr
*Attorney, Agent, or Firm*—Bernard Lieberman; Robert C. Sullivan; Murray M. Grill

[57] ABSTRACT

An improvement is described in microemulsion compositions containing an anionic detergent, one of the specified cosurfactants, a hydrocarbon ingredient and water which comprises the use of a water-insoluble odoriferous perfume as the essential hydrocarbon ingredient in a proportion sufficient to form either a dilute o/w microemulsion composition containing, by weight, 1% to 10% of an anionic detergent, 2% to 10% of cosurfactant, 0.4% to 10% of perfume and the balance water or a concentrated microemulsion composition containing, by weight 18% to 65% of anionic and nonionic detergent, 2% to 30% of cosurfactant, 10% to 50% of perfume and the balance water which upon dilution with water will yield said dilute o/w microemulsion composition.

26 Claims, No Drawings

MICROEMULSION ALL PURPOSE LIQUID CLEANING COMPOSITION

This application is a continuation-in-part of U.S. Ser. No. 866,029 filed May 21, 1986, the entire disclosure of which is incorporated herein by reference.

This invention relates to an improved all-purpose liquid cleaner in the form of a microemulsion designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

More recently, in view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalents tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquids, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undersirable to today's consumers.

Another approach to formulating hard surface or all-purpose liquid detergent compositions where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 Å to about 800 Å in a continuous aqueous phase. In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation. The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; U.K. Patent Application GB 2033421A; U.S. Pat. Nos. 4,017,409; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ration of (a):(b) lying in the range of 5:1 to 1:3; and (c) from about 0.5% to about 10% of a polar solvent having a solubility in water at 15° C. in the range of from about 0.2% to about 10%. Other ingredients present in the formulations disclosed in this patent include from about 0.005% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

Furthermore, the present inventors have discovered that in formulations containing grease-removal assisting magnesium compounds, the addition of minor amounts of builder salts, such as alkali metal polyphosphates, alkali metal carbonates, nitrilotriacetic acid salts, and so on, tends to make it more difficult to form stable microemulsion systems.

SUMMARY OF THE INVENTION

The present invention provides an improved, clear, liquid cleaning composition in the form of a microemulsion which is suitable for cleaning hard surfaces such as plastic, vitreous and metal surfaces having a shiny finish. More particularly, the improved cleansing compositions exhibit good grease soil removal properties when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. Surprisingly, these desirable results are accomplished even in the absence of polyphosphate or other inorganic or organic detergent builder salts and also in the complete absence or substantially complete absence of grease-removal solvent.

In one aspect, the invention generally provides a stable, clear all-purpose, hard surface cleaning composition especially effective in the removal of oily and greasy soil, which is in the form of a substantially dilute oil-in-water microemulsion. The aqueous phase of the dilute o/w microemulsion includes, on a weight basis:

from about 1% to 10% by weight of a primary anionic detergent or about 2% to 20% by weight of a mixture of anionic and nonionic primary detergents, from about 2% to about 10% of a water-miscible cosurfactant having either limited ability or substantially no ability to dissolve oily or greasy soil; and 62% to 96.6% of water, said proportions being based upon the total weight of the composition. The dispersed oil phase of the o/w microemulsion is composed essentially of a water-immiscible or hardly water-soluble perfume constituting from about 0.4% to about 10% by weight of the entire composition.

Quite surprisingly although the perfume is not, per se, a solvent for greasy or oily soil—even though some perfumes may, in fact, contain as much as about 80% of terpenes which are known as good grease solvents—the inventive compositions in dilute form have the capacity to solubilize up to about 10 times or more of the weight of the perfume of oily and greasy soil, which is removed or loosened from the hard surface by virtue of the action of the anionic and nonionic surfactants, said soil being taken up into the oil phase of the o/w microemulsion.

In a second aspect, the invention generally provides highly concentrated microemulsion compositions in the form of either an oil-in-water (o/w) microemulsion or a water-in-oil (w/o) microemulsion which when diluted with additional water before use can form dilute o/w microemulsion compositions. Broadly, the concentrated microemulsion compositions contain, by weight, 10% to 35% of primary anionic detergent, 8% to 30% of water-soluble nonionic detergent, 2% to 30% of cosurfactant, 10% to 50% of perfume and 10% to 50% of water. The concentrated microemulsions can be diluted with up to 20 times their weight of water to form o/w microemulsions.

DETAILED DESCRIPTION OF THE INVENTION

The detergent compositions of the present invention are in the form of an oil-in-water microemulsion in the first aspect or after dilution with water in the second aspect, with the essential ingredients being water, detergent, cosurfactant and hydrocarbon.

According to the present invention, the role of the hydrocarbon is provided by a non-water-soluble perfume. Typically in aqueous based compositions the presence of a solubilizer, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: The compositions are both clear (as a consequence of the formation of a microemulsion) and highly fragranced (as a consequence of the perfume level).

Second, the need for use of solubilizers, which do not contribute to cleaning performance, is eliminated.

Third, an improved grease removal capacity in neat (undiluted) usage of the dilute aspect or after dilution of the concentrate can be obtained without detergent builders or buffers or conventional grease removal solvents at neutral or acidic pH and at low levels of active ingredients while improved cleaning performance can also be achieved in diluted usage.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., a mixture of natural oils or oil constituents) and synthetic (i.e., a single or mixture of synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The perfume is present in the dilute o/w microemulsion in an amount of from about 0.4% to about 10% by weight, preferably from about 0.6% to about 2% by weight, especially preferably from about 0.9% to about 1.1% by weight, such as about 1.0 weight percent. If the amount of perfume is less than about 0.4% by weight it becomes difficult to form the o/w microemulsion. If the perfume is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than about 20%, usually less than about 30%, of such terpene solvents. Thus, merely as a practical matter, based on economic considerations, the dilute o/w microemulsion detergent cleaning compositions of the present invention may often include as much as about 0.2% to about 7% by weight, based on the total composition, of terpene solvents introduced thereinto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

Thus, for a typical formulation of a diluted o/w microemulsion according to this invention a 20 milliliter sample of o/w microemulsion containing 1% by weight of perfume will be able to solubilize, for example, up to about 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent. In other words, it is an essential feature of the compositions of this invention that grease removal is a function of the result of the microemulsion, per se, and not of the presence or absence in the microemulsion of a "greasy soil removal" type of solvent.

Regarding the primary detergent present in the o/w microemulsions any of the conventionally used water-soluble anionic detergents or mixtures of said anionic detergents and anionic detergents can be used in this invention. As used herein the term "primary surfactant" is intended to refer to the class of anionic and mixed anionic-nonionic detergents providing detersive action and to distinguish from the "cosurfactant" component, the function of which is to form and stabilize the microemulsion but which need not necessarily be a detersive active material.

The water-soluble organic detergent materials which are used in forming the ultimate o/w microemulsion compositions of this invention may be selected from the group consisting of water-soluble, non-soap, anionic detergents as well as mixtures of said anionic detergents with water-soluble nonionic and polar nonionic detergents as well. In the preferred diluted o/w microemulsion compositions, a mixture of anionic and nonionic detergents is employed, whereas in the concentrates the mixture of anionic and nonionic detergents is preferred.

Suitable water-soluble non-soap, anionic detergents include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkenyl or acyl group. Such detergents are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic detergents are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates. A preferred sulfonate is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic detergents are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an $\alpha$ olefin.

Other examples of suitable anionic sulfonate detergents are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate detergents are the $C_8$–$C_{18}$ alkyl sulfate salts and the $C_8$–$C_{18}$ alkyl ether polyethenoxy sulfate salts having the formula $R(OC_2H_4)_n OSO_3M$ wherein n is 1 to 12, preferably 1 to 5, and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$–$C_{15}$ alkyl ether polyethenoxy carboxylates having the structural formula $R(OC_2H_4)_nOX$ COOH wherein n is a number from 4 to 12, preferably 5 to 10 and X is selected from the group consisting of $CH_2$, $C(O)R_1$ and

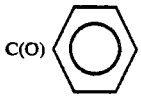

wherein $R_1$ is a $C_1$–$C_3$ alkylene group. Preferred compounds include $C_9$–$C_{11}$ alkyl ether polyethenoxy (7–9) $C(O)CH_2CH_2COOH$, $C_{13}$–$C_{15}$ alkyl ether polyethenoxy (7–9)

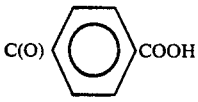

and $C_{10}$–$C_{12}$ alkyl ether polyethenoxy (5–7) $CH_2COOH$. These compounds may be prepared by condensing ethylene oxide with the appropriate alkanol and reacting this reaction product with chloracetic acid to make the ether carboxylic acids as shown in U.S. Pat. No. 3,741,911 or with succinic anhydride or phthalic anhydride. Obviously, these anionic detergents will be present either in acid form or salt form depending upon the pH of the final composition, with salt forming cation being the same as for the other anionic detergents.

Of the foregoing non-soap anionic detergents, the preferred detergents are the $C_9$–$C_{15}$ linear alkylbenzene sulfonates and the $C_{13}$–$C_{17}$ paraffin or alkane sulfonates. Particularly, preferred compounds are sodium $C_{10}$–$C_{13}$ alkylbenzene sulfonate and sodium $C_{13}$–$C_{17}$ alkane sulfonate.

Generally, the proportion of anionic detergent will be in the range of 1% to 10%, preferably from 2% to 6%, by weight of the dilute o/w microemulsion composition.

When present, the water-soluble or water dispersible nonionic detergents that are employed in the inventive compositions are generally the condensation product of an organic aliphatic or alkyl aromatic hydrophobic compound and hydrophilic ethylene oxide groups. Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. Further, the length of the polyetheneoxy chain can be adjusted to achieve the desired balance between the hydrophobic and hydrophilic elements.

Particularly suitable nonionic detergents are the condensation products of a higher alcohol containing about 8 to 18 carbon atoms in a straight or branched-chain configuration condensed with about 0.5 to 30, preferably 2 to 10, moles of ethylene oxide. A particularly preferred compound is $C_9$–$C_{11}$ alkanol ethoxylate (5EO) which also is abbreviated $C_9$–$C_{11}$ alcohol EO 5:1 and $C_{12}$–$C_{15}$ alkanol ethoxylate (7EO) which also is abbreviated as $C_{12}$–$C_{15}$ alcohol EO 7:1. These preferred compounds are commercially available from Shell Chemical Co. under the tradenames Dobanol 91-5 and Neodol 25-7.

Other suitable nonionic detergents are the polyethylene oxide condensates of one mole of alkyl phenol containing from about 6 to 12 carbon atoms in a straight- or branched-chain configuration with about 2 to 30, preferably 2 to 15, moles of ethylene oxide, such as nonyl phenol condensed with 9 moles of ethylene oxide, dodecyl phenol condensed with 15 moles of ethylene and dinonyl phenol condensed with 15 moles of ethylene oxide. These compounds are not the most preferred because they are not as biodegradable as the ethoxylated alkanols described above.

Another well-known group of satisfactory nonionic detergents is marketed under the trade name "Pluronics". These compounds are formed by condensing ethylene oxide with a hydrophobic base formed by the condensation of propylene oxide with propylene glycol. The molecular weight of the hydrophobic portion of the molecule is of the order of 950 to 4,000 and preferably 1,200 to 2,500. The addition of polyoxyethylene radicals to the hydrophobic portion tends to increase the solubility of the molecule as a whole. The molecular weight of the block polymers varies from 1,000 to 15,000, and the polyethylene oxide content may comprise 20% to 80% by weight.

Still another group of satisfactory nonionic detergents is a condensate of a $C_{10}$–$C_{16}$ alkanol with a heteric mixture of ethylene oxide and propylene oxide. The mole ratio of ethylene oxide to propylene oxide is from 1:1 to 4:1, preferably from 1.5:1 to 3.0:1, with the total of the ethylene oxide and propylene oxide contents (including the terminal ethanol group or propanol group) being from 60% to 85%, preferably 70% to 80%, of the nonionic detergent molecular weight. Preferably, the higher alkanol contains 12 to 15 carbon atoms and a preferred compound is the condensation product of $C_{13}$–$C_{15}$ alkanol with 4 moles of propylene oxide and 7 moles of ethylene oxide. Such preferred compounds are commercially available from BASF Company under the tradename Lutensol LF.

Also suitable are the nonionic detergents that are derived from the condensation of ethylene oxide with the product resulting from the reaction of propylene oxide and ethylene diamine. For example, compounds containing from about 40 percent to about 80 percent polyoxyethylene by weight and having a molecular weight of from about 5,000 to 11,000 resulting from the reaction of et ylene oxide groups with a hydrophobic base constituted of the reaction product of ethylene diamine and excess propylene oxide, the bases having a molecular weight on the order of 2,500 to 3,000, are satisfactory.

The polar nonionic detergents which may be substituted for the nonionic detergents described above are those in which the hydrophilic group contains a semipolar bond directly between two atoms, for example, $N \rightarrow O$ and $P \rightarrow O$. There is charge separation between the two directly bonded atoms, but the detergent molecule bears no net charge and does not dissociate into ions.

Suitable polar nonionic detergents include open-chain aliphatic amine oxides of the general formula $R_1—R_2—R_3N \rightarrow O$, wherein $R_1$ is an alkyl, alkenyl or monohydroxyalkyl radical having about 10 to 16 carbon atoms and $R_2$ and $R_3$ are each selected from the group consisting of methyl, ethyl, propyl, ethanol, and propanol radicals. Preferred amine oxides are the $C_{10}$–$C_{16}$ alkyl dimethyl and dihydroxyethyl amine oxides, e.g., lauryl dimethyl amine oxide and lauryl myristyl dihydroxyethyl amine oxide. Other operable polar nonionic detergents are the related open-chain aliphatic phosphine oxides having the general formula $R_1R_2R_3P\rightarrow O$ wherein $R_1$ is an alkyl, alkenyl or monohydroxyalkyl radical ranging in chain length from 10 to 18 carbon atoms, and $R_2$ and $R_3$ are each alkyl or monohydroxyalkyl radicals containing from 1 to 3 carbon atoms. As with the amine oxides, the preferred phosphine oxides are the $C_{10}$–$C_{16}$ alkyl dimethyl and dihydroxyethyl phosphine oxides.

Generally, in the preferred dilute o/w microemulsion compositions the nonionic detergent will be present in admixture with the anionic detergent. The proportion of nonionic detergent based upon the weight of the final dilute o/w microemulsion composition will be 0.1% to 8%, more preferably 2% to 6%, by weight. Furthermore, in the more preferred compositions the weight ratio of anionic detergent to nonionic detergent will be in the range of 1:3 to 3:1 with especially good results being obtained at a weight ratio of 1.3:1.

The cosurfactant plays an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is drastically reduced to a value close to 0 ($10^{-3}$ dynes/cm). This reduction of the interfacial tension results in spontaneous break-up of the emulsion droplets to consecutively smaller aggregates until the state of a transparent colloidal sized emulsion, e.g., a microemulsion, is formed. In the state of a microemulsion, thermodynamic factors come into balaance with varying degrees of stability related to the total free energy of the microemulsion. Some of the thermodynamic factors involved in determining the toal free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of the cosurfactant in formation of a stable o/w microemulsion is to (a) decrease interfacial tension (2); and (b) modify the microemulsion structure and increase the number of possible configurations (3). Also, the cosurfactant will (c) decrease the rigidity.

Four major classes of compounds have been found to provide highly suitable cosurfactants over temperature ranges extending from 5° C. to 43° C., for instance, (1) water-soluble $C_3$–$C_4$ alkanols, polypropylene glycols of the formula $HO(CH_3CHCH_2O)_nH$ wherein n is a number from 2 to 18 and monoalkyl ethers and esters of ethylene glycol and propylene glycol having the structural formulas $RO(X)_nH$ and $R_1O(X)_nH$ wherein R is $C_1$–$C_4$ alkyl, $R_1$ is $C_2$–$C_4$ acyl group, X is $(CH_2CH_2O)$ or $(CH_3CHCH_2O)$ and n is a number from 1 to 4; (2) aliphatic mono-and di-carboxylic acids containing 3 to 6 carbons in the molecule; (3) the aforementioned alkyl ether polyethenoxy acids discussed above when the anionic carboxylate form of this compound is not present; and (4) triethyl phosphate. Additionally, mixtures of two or more of the four classes of cosurfactant compounds may be employed where specific pH's are desired.

Representative members of the polypropylene glycol ethers include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, tetraethylene glycol monobutyl ether, propylene glycol tertiary butyl ether, ethylene glycol monoacetate and dipropylene glycol propionate.

From the standpoint of providing stable microemulsions over a broad range of temperatures while avoiding any problems related to toxicity and/or environmental safety, two ethers based on dipropylene glycol are particularly preferred as cosurfactants, namely, dipropylene glycol monobutyl ether and dipropylene glycol isobutyl ether.

Representative members of the (2) aliphatic carboxylic acids include $C_3$–$C_6$ alkyl and alkenyl monobasic acids and dibasic acids such as glutaric acid and mixtures of glutaric acid with adipic acid and succinic acid, as well as mixtures of the foregoing acids.

While all of the aforementioned glycol ether compounds and acid compounds provide the described stability, the most preferred cosurfactant compounds of each type, on the basis of cost and cosmetic appearance (particularly odor), are diethylene glycol monobutyl ether and a mixture of adipic, glutaric and siccinic acids, respectively. The ratio of acids in the foregoing mixture is not particularly critical and can be modified to provide the desired odor. Generally, to maximize water solubility of the acid mixture glutaric acid, the most water-soluble of these three saturated aliphatic dibasic acids, will be used as the major component. Generally, weight ratios of adipic acid: glutaric acid: succinic acid is 1–3:1–8:1–5, preferably 1–2:1–6:1–3:, such as 1:1:1, 1:2:1, 2:2:1, 1:2:1.5, 1:2:2, 2:3:2, etc., can be used with equally good results.

Still other classes of cosurfactant compounds providing stable microemulsion compositions at low and elevated temperatures are the aforementioned alkyl ether polyethenoxy carboxylic acids and the mono-, di- and triethyl esters of phosphoric acid such as triethyl phosphate.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 2% to 10%, preferably from about 3 to 7%, especially preferably from about 3.5 to 6%, by weight provide stable dilute o/w microemulsions for the above-described levels of primary surfactants and perfume and any other additional ingredients as described below.

As will be appreciated by the practitioner, the pH of the final microemulsion will be dependent upon the identity of the cosurfactant compound, with the choice of the cosurfactant being effected by cost and cosmetic properties, particularly odor. For example, microemulsion compositions which have a pH in the range of 1 to 10 may employ either the class 1 or the class 4 cosurfactant as the sole surfactant, but the pH range is reduced to 1 to 8.5 when the polyvalent metal salt is present. On the other hand, the class 2 cosurfactant can only be used as the sole cosurfactant where the product pH is below 3.2. Similarly, the class 3 cosurfactant can be used as the sole surfactant where the product pH is below 5. However, where the acidic cosurfactants are employed in admixture with a glycol ether cosurfactant, compositions can be formulated at a substantially neutral pH (e.g., pH 7±1.5, preferably 7±0.2).

The ability to formulate neutral and acidic products without builders which have grease removal capacities is a uniquie feature of the present invention because the prior art o/w microemulsion formulations most usually are highly alkaline or highly built or both.

In addition to their excellent capacity for cleaning greasy and oily soils, the low pH o/w microemulsion formulations also exhibit excellent cleaning performance and removal of soap scum and lime scale in neat (undiluted) as well as in diluted usage.

The final essential ingredient in the inventive microemulsion compositions is water. The proportion of water in the dilute o/w microemulsion compositions generally is in the range of 62% to 96.6%, preferably 79% to 92.4% by weight of the usual diluted o/w microemulsion composition.

As believed to have been made clear from the foregoing description, the dilute o/w microemulsion liquid all-purpose cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds (i.e., primary anionic and nonionic detergents) dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serves to boost cleaning performance of the primary detergents in dilute usage.

On the other hand, it is also within the scope of this invention to formulate highly concentrated microemulsions which will be diluted with additional water before use. For example, concentrated microemulsions are prepared by mixing the following amounts of primary surfactants, cosurfactant, perfume and water:

| Ingredient | Amount (wt %) | |
|---|---|---|
| | Broad | Preferred |
| Anionic Surfactant | 10–35 | 12–28 |
| Nonionic Surfactant | 8–30 | 10–20 |
| Cosurfactant | 2–30 | 4–15 |

-continued

| Ingredient | Amount (wt %) | |
|---|---|---|
| | Broad | Preferred |
| Perfume | 10–50 | 25–45 |
| Water | 10–50 | 22–40 |

Such concentrated microemulsions can be diluted by mixing with up to about 20 times or more, preferably about 4 to about 10 times, their weight of water to form o/w microemulsions similar to the diluted microemulsion compositions described above. While the degree of dilution is suitably chosen to yield an o/w microemulsion composition after dilution, it should be recognized that during the course of dilution both microemulsion and non-microemulsions may be successively encountered.

In addition to the above-described essential ingredients required for the formation of the microemulsion composition, the compositions of this invention may often and preferably do contain one ore more additional ingredients which serve to improve overall product performance.

One such ingredient is an inorganic or organic salt or oxide of a multivalent metal cation, particularly $Mg++$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide a stoichiometric equivalent between the anionic surfactant and the multivalent metal cation. For example, for each gram-ion of $Mg++$ there will be 2 gram moles of paraffin sulfonate, alkylbenzene sulfonate, etc., while for each gram-ion of $Al^{3+}$ there will be 3 gram moles of anionic surfactant. Thus, the proportion of the multivalent salt generally will be selected so that one equivalent of compound will neutralize from 0.5 to 1.5 equivalents, preferably 0.9 to 1.1 equivalents, of the acid form of the anionic detergent. At higher concentrations of anionic detergent, the amount of multivalent salt will be in range of 0.5 to 0.1 equivalents per equivalent of anionic detergent.

Optionally, the o/w microemulsion compositions will include minor amounts, i.e., from 0.1% to 2.0%, preferably from 0.25% to 1.0% by weight of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present.

As examples of the fatty acids which can be used as such or in the form of soap, mention can be made of distilled coconut oil fatty acids, "mixed vegatable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The all-purpose liquid cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the all-purpose liquids are clear oil-in-water microemulsions and exhibit stability at reduced and increased temperatures. More specifically, such compositions remain clear and stable in the range of 5° C. to 50° C., especially 10° C. to 43° C. Such compositions exhibit a pH in the acid or neutral range depending on intended end use. The liquids are readily pourable and exhibit a viscosity in the range of 6 to 60 centipoises (cps.) as measured at 25° C. with a Brookfield RVT Viscometer using a #1 spindle rotating at 20 RPM. Preferably, the viscosity is maintained in the range of 10 to 40 cps.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the o/w microemulsion, the compositions are easily prepared simply by combining all of the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following composition is prepared:

| | weight % |
|---|---|
| Sodium $C_{13}$–$C_{17}$ Paraffin sulfonate | 4 |
| $C_9$–$C_{11}$ alcohol EO 5:1 | 3 |
| Ethylene glycol monobutyl ether | 5 |
| Perfume (a) | 1 |
| Mg $SO_4 \cdot 7\ H_2O$ | 1.5 |
| Water | balance |
| pH 7.0 ± 0.2 | 100% |

(a) contains about 2% by weight of terpenes.

This composition is a stable clear "homogeneous" o/w microemulsion. As a measure of "dissolution power" of this composition for water-insoluble liquids, 100 grams of the liquid are placed in a beaker and liquid pentane is added dropwise to the liquid until the composition turns from clear to cloudy. 18 grams of pentane are solubilized and the liquid remains clear and homogeneous. Similarly, when petroleum ether (b.p. 60°–80° C.) is used as the water-insoluble liquid, 15 grams can be "dissolved" in the liquid o/w microemulsion without resulting in phase separation and without the liquid becoming cloudy.

Furthermore, "dissolution power" of the o/w microemulsion of this example is compared to the "dissolution power" of an identical composition except that an equal amount (5 weight percent) of sodium cumene sulfonate hydrotrope is used in place of the ethylene glycol monobutyl ether cosurfactant in a test wherein equal concentrations of heptane are added to both compositions. The o/w microemulsion of this invention solubilizes 12.6 grams of the water immiscible substance as compared to 1.4 grams in the hydrotrope containing liquid composition.

In a further comparative test using blue colored cooking oil—a fatty triglyceride soil—the composition of Example 1 is clear after the addition of 0.2 grams of cooking oil whereas the cooking oil floats on the top of the composition containing the sulfonate hydrotrope.

When the concentration of perfume is reduced to 0.4% in the composition of Example 1, a stable o/w microemulsion composition is obtained. Similarly, a stable o/w microemulsion is obtained when the concentration of perfume is increased to 2% by weight and the concentration of cosurfactant is increased to 6% by weight in Example 1.

EXAMPLE 2

This example illustrates a typical formulation of a "concentrated" o/w microemulsion based on the present invention:

| | % by weight |
|---|---|
| Sodium $C_{13}$-$C_{17}$ Paraffin Sulfonate | 20 |
| $C_9$-$C_{11}$ alcohol EO 5:1 | 15 |
| Ethylene glycol monobutyl ether | 20 |
| Perfume (a) | 15 |
| Water | 30 |
| pH: 7.0 ± 0.2 | |

This concentrated formulation can be easily diluted, for example, five times with tap water, to yield a diluted o/w microemulsion composition. Thus, by using microemulsion technology it becomes possible to provide a product having high levels of active detergent ingredients and perfumes, which has high consumer appeal in terms of clarity, odor and stability, and which is easily diluted at the usual usage concentration for similar all-purpose hard surface liquid cleaning compositions, while retaining its cosmetically attractive attributes.

Naturally, these formulations can be used, where desired, without further dilution and can also be used at full or diluted strength to clean soiled fabrics by hand or in an automatic laundry washing machine.

EXAMPLE 3

This example illustrates a diluted o/w microemulsion composition according to the invention having an acidic pH and which also provides improved cleaning performance on soap scum and lime scale removal as well as for cleaning greasy soil.

| | % by weight |
|---|---|
| Sodium $C_{13}$-$C_{17}$ paraffin sulfonate | 4.0 |
| $C_9$-$C_{11}$ alcohol EO 5:1 | 3.0 |
| Mg $SO_4.7H_2O$ | 1.5 |
| Mixture of succinic acid/glutaric acid/adipic acid (1:1:1) | 5.0 |
| Perfume (b) | 1.0 |
| Water, minors (dye) | balance to 100 |
| pH = 2.5 ± 0.2 | |

(b) contains about 40% by weight of terpene

EXAMPLE 4

This example describes a dilute o/w microemulsion composition according to the invention in which magnesium dodecylbenzene sulfonate is the anionic detergent and said detergent is formed in situ.

| | % by weight |
|---|---|
| Magnesium oxide | 0.33 |
| Dodecylbenzene sulfonic acid | 5.25 |
| $C_9$-$C_{11}$ alcohol EO 7.5-8:1 | 1.75 |
| Diethylene glycol monobutyl ether | 4.0 |
| Perfume (a) | 1.0 |
| Water | balance to 100 |
| pH = 7 ± 0.2 | |

The foregoing composition is prepared by dispersing the magnesium oxide in water followed by the addition of the dodecylbenzene sulfonic acid with agitation to form the neutralized sulfonate. Thereafter, the nonionic detergent, the cosurfactant and the perfume are added in sequence to form an o/w microemulsion composition having a pH of 7.0±0.2.

EXAMPLE 5

The compositions of Examples 1 and 3 are prepared by replacing the magnesium sulfate heptahydrate with 0.25% weight percent MgO (i.e., an equivalent molar amount) and satisfactory o/w microemulsion compositions are obtained.

EXAMPLE 6

This example shows typical o/w microemulsion compositions according to this invention which contain a fatty acid foam suppressor:

| | % by weight | |
|---|---|---|
| | A | B |
| Sodium $C_{13}$-$C_{17}$ paraffin sulfonate | 4.0 | 4.0 |
| $C_9$-$C_{11}$ alcohol EO 5:1 | 3.0 | 3.0 |
| Magnesium oxide (MgO) | 0.25 | 0.25 |
| Distilled coconut oil fatty acids* | 0.5 | 0.5 |
| Diethylene glycol monobutyl ether | 5.0 | — |
| Ethylene glycol monobutylether | — | 5.0 |
| Perfume | 1.0 (a) | 1.0 (c) |
| Dye | 0.0015 | 0.0015 |
| $H_2SO_4$ | to pH 6.8 ± 0.2 | |
| Formalin | 0-0.2 | 0-0.2 |
| Antioxidant | 0-0.1 | 0-0.1 |
| $H_2O$ | balance to 100 | |

*$C_8$-$C_{18}$ fatty acids
(c) contains about 70% by weight of terpenes

EXAMPLE 7

This example illustrates other typical dilute o/w microemulsions according to this invention especially suitable for spray and wipe type applications:

| | % by weight | |
|---|---|---|
| | A | B |
| Sodium $C_{13}$-$C_{17}$ paraffin sulfonate | 4.0 | 4.0 |
| $C_9$-$C_{11}$ alcohol EO 5:1 | 3.0 | 4.0 |
| MgO | 0.25 | 0.25 |
| Diethylene glycol monobutyl ether | 3.75 | — |
| Ethylene glycol monobutyl ether | — | 3.75 |
| Perfume | 1.0 (d) | 1.0 (c) |
| $H_2SO_4$ | to pH 6.8 ± 0.2 | |
| Formalin | 0-0.2 | 0-0.2 |
| Antioxidant | 0-0.1 | 0-0.1 |
| Water | balance to 100 | |

(d) Contains by weight about 43% d-limonene, 10% grapefruit oil and 6% of other terpenes.

EXAMPLE 8

The composition of Example 7A is repeated with the exception that the formalin and antioxidant ingredients are omitted and the cleaning properties of this compositionare compared with an identical composition in which the 1% perfume is replaced by 1% by weight of water.

The cleaning performance is based upon a grease soil removal test. In the grease soil removal test, white Formica tiles (15 cm.×15 cm.) are sprayed with a chloroform solution containing 5% cooking fat, 5% hardened tallow and a sufficient amount of an oil soluble dye to render the film visible. After permitting the tiles to dry for about one quarter hour at room temperature (24° C.), the tiles are mounted in a Gardner Washability Machine equipped with two cellulose sponges measuring 5 cm.×5 cm.×5 cm. 2.5 grams of the liquid cleaning composition being tested are pipetted onto the sponge and the number of strokes required to remove the grease film is determined. Products are evaluated in pairs and usually six replications are run on each composition. The products are deemed to differ in performance if the mean number of strokes for each product differs by at least five (5) strokes.

The following results obtained are set forth in Table A below:

TABLE A

| Formulation | Mean number of Strokes |
|---|---|
| Ex. 7-A | 25 |
| Ex. 7-A without perfume | 48 |

The results in Table A clearly show that the presence of 1% by weight of perfume in the inventive composition reduces the number of strokes required for cleaning by almost fifty percent, i.e., $$\frac{48-25}{48} = 23/48 \times 100\% \text{ or } 48\%.$$

Such a result is truly surprising.

EXAMPLE 9

This example is presented to show that in the formulation of this invention the cosurfactant does not contribute to grease removal performance. The cleaning performance test described in Example 8 is repeated using the o/w microemulsion of Example 7-A and an identically prepared composition with the exception that the diethylene glycol monobutyl ether is substituted by an equal weight of water. The results obtained are set forth in Table B.

TABLE B

| Formulation | Mean Number of Strokes |
|---|---|
| Ex. 7-A | 25 |
| Ex. 7-A without cosurfactant | 20 |

While the foregoing results clearly show that the cosurfactant does not contribute to grease removal performance, it should be noted that the composition without cosurfactant is opaque and self-opacified after manufacture. Furthermore, when the test is repeated using perfume (a) containing 2% terpenes in place of the perfume containing 60% terpenes in Example 7A, 25 strokes are required for cleaning for the composition of Example 7A and for the composition without cosurfactant. In an additional variation of the experiment using 1% by weight of a perfume containing 70% terpenes (perfume c) in the composition of Example 7A, 25 strokes are required for said composition and 20 strokes are required for the composition without cosurfactant. Thus, the comparative experiments prove that the cosurfactant is not functioning as a grease removal solvent in the inventive microemulsion compositions.

When an additional comparison is made between the composition of Example 7A and an identical composition except that the diethylene glycol monobutyl ether (DEGMBE) cosurfactant is replaced by an equivalent weight of a 1/1/1 mixture of succinic acid/glutaric acid/adipic acid, the following results are obtained:

| Formulation | Mean Number of Strokes |
|---|---|
| Ex. 7-A | 25 |
| Ex. 7-A with diacid mixture in place of DEGMBE | 25 |

The foregoing comparatives also demonstrate that the grease removal capacity of the o/w microemulsions of this invention is based on the "dissolving power" of the microemulsion, per se, rather than on the presence or absence of grease-removal solvent because similar performance results are achieved with other perfumes containing essentially no terpenes as well as with perfumes containing 60% and 70% by weight of terpenes.

EXAMPLE 10

The ability of the inventive compositions to solubilize oleic acid soil is illustrated when the following compositions are compared using the "dissolution power" test in Example 1.

| | % by weight | | | |
|---|---|---|---|---|
| Ingredient | 10A | 10B | 10C | 10D |
| Sodium $C_{13}$-$C_{17}$ paraffin sulfonate | 4.0 | 4.0 | 4.0 | 4.0 |
| $C_9$-$C_{11}$ alcohol EO 5:1 | 3.0 | 3.0 | 3.0 | 3.0 |
| Diethylene glycol monobutyl ether | 4.0 | 4.0 | — | — |
| Magnesium oxide | 0.25 | 0.25 | 0.25 | 0.25 |
| Sodium cumene sulfonate | — | — | 4.0 | 4.0 |
| Perfume (a) | 1.0 | 0.4 | 1.0 | 0.4 |
| Water | balance to 100 | | | |

The dissolution power of 100 gms of these compositions is set forth in Table C below

TABLE C

| Formulation | Gms of Oleic Acid Solubilized |
|---|---|
| 10A | 6 |
| 10B | 7 |
| 10C | 1.2 |
| 10D | 1.2 |

In the foregoing comparisons, the dilute o/w microemulsion composition solubilizes five times more oleic acid than a non-microemulsion composition containing cumene sulfonate hydrotrope in place of the cosurfactant.

In summary, the described invention broadly relates to an improvement in microemulsion compositions containing an anionic detergent, one of the specified cosurfactants, a hydrocarbon ingredient and water which comprises the use of a water-insoluble, odoriferous perfume as the essential hydrocarbon ingredient in a proportion sufficient to form either a dilute o/w microemulsion composition containing, by weight, 1% to 10% of an anionic detergent, 2% to 10% of cosurfactant, 0.4% to 10% of perfume and the balance water or a concentrated microemulsion composition containing, by weight, 18% to 65% of anionic and nonionic detergent, 2% to 30% of cosurfactant, 10% to 50% of perfume and the balance water which upon dilution with water will provide said dilute o/w microemulsion composition.

We claim:

1. In a stable microemulsion composition containing a water-soluble non-soap anionic detergent comprising an organic hydrophobic group of 8 to 26 carbon atoms and at least one water-solubilizing group selected from the group consisting of sulfonate, sulfate and carboxylate, a cosurfactant selected from the group consisting of water-soluble $C_3$–$C_4$ alkanols; polypropylene glycol; $C_1$–$C_4$ mono-alkyl ethers and esters of ethylene glycol or propylene glycol; aliphatic mono- and di-carboxylic acids containing 3 to 6 carbons in the molecule; $C_9$–$C_{15}$ alkyl ether polyethenoxy carboxylic acids of the structural formula $R(OC_2H_4)_nOX$ COOH wherein R is $C_9$–$C_{15}$ alkyl, n is a number from 4 to 12 and X is selected from the group consisting of $CH_2$, $C(O)R_1$ and

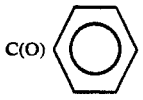

wherein $R_1$ is a $C_1$–$C_3$ alkylene group, with the proviso that the anionic carboxylate form of the $C_9$–$C_{15}$ alkyl ether polyethenoxy carboxylic acid is not present; monoethyl phosphate, diethyl phosphate and triethyl phosphate;

a $C_8$–$C_{22}$ fatty acid or a soap of said fatty acid;

a hydrocarbon; and water;

the improvement which comprises the use of water-insoluble perfume as the essential hydrocarbon ingredient in a proportion sufficient to form a dilute oil-in-water (o/w) microemulsion composition consisting essentially of, by weight, 1% to 10% of said anionic detergent, 2% to 10% of said cosurfactant, 0% to 2.0% of said fatty acid or said soap of said fatty acid, 0.4% to 10% of said perfume and the balance water.

2. A stable, clear, all-purpose, hard surface cleaning composition which is especially effective in the removal of oily and greasy soil, in the form of an oil-in-water microemulsion (o/w), the aqueous phase of said microemulsion composition comprising, on a weight basis of the entire composition, from about 1% to 10% of a non-soap water-soluble anionic detergent comprising an organic hydrophobic group of 8 to 26 carbon atoms and at least one water-solubilizing group selected from the group consisting of sulfonate, sulfate and carboxylate;

from about 2% to about 10% of a water-miscible cosurfactant having substantially no ability to dissolve oily or greasy soil selected from the group consisting of water-soluble $C_3$–$C_4$ alkanols; polypropylene glycol; $C_1$–$C_4$ mono-alkyl ethers and esters of ethylene glycol or propylene glycol; aliphatic mono-and di-carboxylic acids containing 3 to 6 carbons in the molecule; $C_9$–$C_{15}$ alkyl ether polyethenoxy carboxylic acids of the structural formula $R(OC_2H_4)_nOX$ COOH wherein R is $C_9$–$C_{15}$ alkyl, n is a number from 4 to 12 and X is selected from the group consisting of $CH_2$, $C(O)R_1$ and

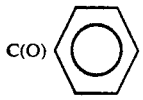

wherein $R_1$ is a $C_1$–$C_3$ alkylene group, with the proviso that the anionic carboxylate form of the $C_9$–$C_{15}$ alkyl ether polyethenoxy carboxylic acid is not present; monoethyl phosphate; diethyl phosphate and triethyl phosphate;

0% to 2.0% of a $C_8$–$C_{22}$ fatty acid or a soap of said fatty acid; and the balance water; and the oil phase of said microemulsion consists essentially of a perfume in an amount of from about 0.4% to about 10% perfume by weight of the entire composition;

said composition being particularly effective in removing oil or greasy soil from hard surfaces by solubilizing the oily or greasy soil in the oil phase of said microemulsion.

3. The cleaning composition of claim 2 wherein said aqueous phase contains, in addition, from 0.1% to 8% by weight of a water-soluble nonionic surfactant.

4. The cleaning composition of claim 3 wherein said aqueous phase contains from about 2% to 6% of said anionic detergent and from about 2% to 6% of said nonionic surfactant.

5. The cleaning composition of claim 2 wherein said aqueous phase further contains a water-soluble salt of a multivalent metal cation in an amount sufficient to provide from 0.5 to 1.5 equivalents of said cation per equivalent of said anionic detergent.

6. The cleaning composition of claim 5 wherein the multivalent metal cation is magnesium or aluminum.

7. The cleaning composition of claim 5 wherein said composition contains 0.9 to 1.1 equivalents of said cation per equivalent of anionic detergent.

8. The cleaning composition of claim 6 wherein said multivalent salt is magnesium oxide or magnesium sulfate.

9. The cleaning composition of claim 4 which contains from about 3% to about 7% by weight of said cosurfactant and from about 0.6% to about 2.0% by weight of said perfume.

10. The cleaning composition of claim 2 wherein the cosurfactant is a water soluble glycol ether.

11. The cleaning composition of claim 10 wherein the glycol ether is selected from the group consisting of ethylene glycol monobutylether, diethylene glycol monobutyl ether, triethylene glycol monobutylether, polypropylene glycol having an average molecular weight of from about 200 to 1,000 and propylene glycol tert.butyl ether.

12. The cleaning composition of claim 10 wherein the glycol ether is dipropylene glycol monobutyl ether or dipropylene glycol isobutyl ether.

13. The cleaning composition of claim 2 wherein the cosurfactant is a $C_3$–$C_6$ aliphatic carboxylic acid selected from the group consisting of acrylic acid, propionic acid, glutaric acid, mixtures of glutaric acid and succinic acid and adipic acid and mixtures of any of the foregoing.

14. The cleaning composition of claim 13 wherein the aliphatic carboxylic acid is a mixture of adipic acid, glutaric acid and succinic acid.

15. The cleaning composition of claim 3 wherein the anionic surfactant is a $C_9$–$C_{15}$ alkyl benzene sulfonate or a $C_{10}$–$C_{20}$ alkane sulfonate and the nonionic surfactant is a condensation product of alkanol having from 8 to 22 carbon atoms either with about 2 to 30 moles of ethylene oxide per mole alkanol or a condensate of a $C_{10}$–$C_{16}$ alkanol with a heteric mixture of ethylene oxide and propylene oxide in a mole ratio of ethylene oxide to propylene oxide of 1:1 to 4:1, with the total weight of alkylene oxide being from 60% to 85% of the condensation product.

16. The cleaning composition of claim 14 which comprises, by weight, 2% to 6% of said anionic detergent, 2% to 6% of an nonionic detergent, 3% to 7% of a cosurfactant selected from the group consisting of water soluble glycol ethers and $C_3$–$C_6$ aliphatic mono- and di-basic carboxylic acids, 0.6% to 2% of a perfume containing up to at most about 70% of terpene oil; and 0.5 to 1.5 equivalents of a magnesium salt per equivalent of anionic detergent and 79% to 92.4% of water.

17. The cleaning composition of claim 16 wherein the perfume contains up to at most about 40% of terpene oil.

18. A concentrated liquid cleaning composition in the form of an acidic or neutral, clear, stable, detergent, builder-free microemulsion consisting essentially of, by weight, about 10% to 35% of a water-soluble anionic detergent containing an organic hydrophobic group of 8 to 26 carbon atoms and at least one water-solubilizing group selected from the group consisting of sulfonate, sulfate and carboxylate, about 8% to 30% of a water-soluble nonionic detergent, about 2% to 30% of a cosurfactant selected from the group consisting of water-soluble $C_3$–$C_4$ alkanols, polypropylene glycol, $C_1$–$C_4$ alkyl ethers and esters of ethylene glycol or propylene glycol, aliphatic mono- and di-carboxylic acids containing 3 to 6 carbons in the molecule, $C_9$–$C_{15}$ alkyl ether polyethenoxy carboxylic acids of the structural formula $R(OC_2H_4)_nOX$ COOH wherein R is $C_9$–$C_{15}$ alkyl, n is a number from 4 to 12 and X is selected from the group consisting of $CH_2$, $C(O)R_1$ and

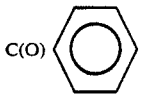

wherein $R_1$ is $C_1$–$C_3$ alkylene, monoethyl phosphate, diethyl phosphate and triethyl phosphate, about 10% to 50% perfume, and about 10% to 50% of water.

19. The concentrated liquid cleaning composition of claim 18 which consists essentially of, by weight, about 12% to 28% of anionic surfactant, about 10% to 20% of nonionic surfactant, about 4% to 15% of said cosurfactant, about 25% to 45% of perfume and about 22% to 40% of water.

20. In a stable microemulsion composition containing a non-soap water-soluble anionic detergent comprising an organic hydrophobic group of 8 to 26 carbon atoms and at least one water-solubilizing group selected from the group consisting of sulfonate, sulfate and carboxylate, a cosurfactant selected from the group consisting of water-soluble $C_3$–$C_4$ alkanols; polypropylene glycol; $C_1$–$C_4$ mono-alkyl ethers and esters of ethylene glycol or propylene glycol; aliphatic mono- and di-carboxylic acids containing 3 to 6 carbons in the molecule; $C_9$–$C_{15}$ alkyl ether polyethenoxy carboxylic acids of the structural formula $R(OC_2H_4)_nOX$ COOH wherein R is $C_9$–$C_{15}$ alkyl, n is a number from 4 to 12 and X is selected from the group consisting of $CH_2$, $C(O)R_1$ and

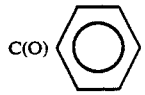

wherein $R_1$ is a $C_1$–$C_3$ alkylene group, with the proviso that the anionic carboxylate form of the $C_9$–$C_{15}$ alkyl ether polyethenoxy carboxylic acid is not present; monoethyl phosphate; diethyl phosphate and triethyl phosphate;

a $C_8$–$C_{22}$ fatty acid or a soap of said fatty acid;

a hydrocarbon;

a water-soluble organic or inorganic salt of a polyvalent metal; and water;

the improvement which comprises the use of water-insoluble perfume as the essential hydrocarbon ingredient in a proportion sufficient to form a dilute oil-in-water (o/w) microemulsion composition consisting essentially of, by weight, 1% to 10% of said anionic detergent, 2% to 10% of said cosurfactant, 0% to 2.0% of a $C_8$–$C_{22}$ fatty acid or a soap of said fatty acid; 0.4% to 10% of said perfume and the balance water, with said water-soluble salt of a polyvalent metal being present in an amount to provide a stoichiometric equivalent between said anionic detergent and the polyvalent metal cation of said polyvalent metal salt.

21. The cleaning composition of claim 1, wherein said perfume is present in an amount of 0.4% to 2%.

22. The cleaning composition of claim 1, wherein said perfume is present in an amount of 0.4 to 1%.

23. The cleaning composition of claim 2, wherein said perfume is present in an amount of 0.4% to 2%.

24. The cleaning composition of claim 2, wherein said perfume is present in an amount of 0.4% to 1%.

25. The cleaning composition of claim 20, wherein said perfume is present in an amount of 0.4% to 2%.

26. The cleaning composition of claim 20, wherein said perfume is present in an amount of 0.4% to 1%.

* * * * *